US007552982B2

(12) United States Patent
Beaudoin

(10) Patent No.: US 7,552,982 B2
(45) Date of Patent: Jun. 30, 2009

(54) DRAWER SLIDE ASSEMBLY WITH CATCH MECHANISM

(75) Inventor: Richard Beaudoin, Drummondville (CA)

(73) Assignee: Logimex Inc., Drummondville, Quebec (CA)

( * ) Notice: Subject to any disclaimer, the term of this patent is extended or adjusted under 35 U.S.C. 154(b) by 673 days.

(21) Appl. No.: 11/360,737

(22) Filed: Feb. 23, 2006

(65) Prior Publication Data

US 2006/0226747 A1 Oct. 12, 2006

Related U.S. Application Data

(60) Provisional application No. 60/654,952, filed on Feb. 23, 2005.

(51) Int. Cl.
*A47B 88/04* (2006.01)

(52) U.S. Cl. ..... 312/334.47; 312/334.46; 312/333

(58) Field of Classification Search ..... 312/330.1, 312/333, 334.1, 334.7, 334.8, 334.44, 334.46, 312/334.47; 384/20, 21, 22; 211/26
See application file for complete search history.

(56) References Cited

U.S. PATENT DOCUMENTS

| | | | | |
|---|---|---|---|---|
| 2,277,702 | A | 3/1942 | Kennedy | |
| 3,386,784 | A * | 6/1968 | Oppenhuizen et al. | 312/334.19 |
| 3,462,203 | A * | 8/1969 | Del Vecchio | 384/19 |
| 3,589,778 | A | 6/1971 | Olson | |
| 4,181,383 | A * | 1/1980 | Naef | 384/19 |
| 4,441,772 | A | 4/1984 | Fielding et al. | |
| 4,469,384 | A | 9/1984 | Fler et al. | |
| 4,560,212 | A | 12/1985 | Papp et al. | |
| 4,728,162 | A * | 3/1988 | Bruneau | 312/333 |
| 4,932,792 | A | 6/1990 | Baxter | |
| 5,181,782 | A | 1/1993 | Wojcik | |
| 5,203,620 | A * | 4/1993 | McLennan | 312/334.46 |
| 5,248,195 | A | 9/1993 | Shin | |
| 5,316,389 | A | 5/1994 | Hoffman | |
| 5,421,653 | A | 6/1995 | Triplette | |
| 5,507,571 | A | 4/1996 | Hoffman | |
| 5,671,988 | A | 9/1997 | O'Neill | |
| 5,868,479 | A | 2/1999 | Hoffman | |
| 6,033,047 | A | 3/2000 | Hoffman | |
| 6,254,205 | B1 * | 7/2001 | Wright et al. | 312/217 |
| 6,254,210 | B1 | 7/2001 | Parvin | |
| 6,402,274 | B1 * | 6/2002 | Reis | 312/334.46 |
| 6,435,636 | B1 | 8/2002 | MacMillan | |
| 6,682,158 | B2 * | 1/2004 | Lai | 312/333 |
| 6,764,149 | B2 | 7/2004 | Jurja | |
| 6,932,200 | B2 | 8/2005 | Booker et al. | |
| 2002/0084735 | A1 | 7/2002 | Liang et al. | |
| 2002/0140330 | A1 | 10/2002 | Hoeppner | |
| 2003/0062812 | A1 | 4/2003 | Hwang et al. | |
| 2003/0197453 | A1 | 10/2003 | Jurja | |

(Continued)

*Primary Examiner*—James O Hansen
(74) *Attorney, Agent, or Firm*—Merchant & Gould P.C.

(57) ABSTRACT

The invention concerns a drawer slide assembly, preferably for use in appliances, comprising a catch mechanism for resisting slide extension when the drawer is in a closed position. The catch mechanism is made of a spring arm pivotally mounted to one of the rails and an anchorage point provided in the other rail. When the assembly is moved to the closed position, the anchorage point engages and rotates the spring arm about its axis. Thus, opening the drawer requires a certain force to rotate the spring back. The use of a simple spring arm reduces friction between parts, reduces assembly costs and maintains desired flexibility and tolerance for drawer production and usage.

12 Claims, 6 Drawing Sheets

U.S. PATENT DOCUMENTS

2004/0007952 A1 1/2004 Domenig et al.
2004/0119388 A1 6/2004 Huang
2004/0174104 A1 * 9/2004 Chen et al. ..... 312/334.47

* cited by examiner

DRAWER SLIDE ASSEMBLY WITH CATCH MECHANISM

FIELD OF THE INVENTION

The present invention generally relates to the field of sliding drawers for appliances, particularly stoves, as well as slide assemblies allowing drawers to be retained and biased in a closed position.

BACKGROUND OF THE INVENTION

Drawer slide assemblies are necessary components for sliding drawers for suspending and sliding the drawers within cabinets and appliances.

Drawer slide assemblies typically comprise two rail slide assemblies, each of which are mounted to a side of the drawer and to the inside walls of an opening in the appliance. The rail slide assemblies are mounted on either side of the sliding path of the drawer. Such an assembly usually comprises an inner channel rail that is attached to the drawer and an outer channel rail that is attached to the rest of the piece of kitchen, household or office furniture. There can also be one or more intermediate channel rails that act as an interface between the inner and outer rails. Sliding means such as ball bearings allow the rails to slide relative to one another. The sliding motion is limited between a fully retracted position (closed) and a fully extended position (open), provided that there are stop levers at the fully closed and fully open positions.

It is often desirable that the drawer, once in its retracted position, require some resistance to be reopened. In order that a drawer does not inadvertently come partially open, catch mechanisms can be used to hold or bias the drawer in its closed position. In the kitchen appliance field, this may be particularly beneficial, since leaks of liquid, food, vapours, smells, heat and cold should be kept to a minimum.

Catch mechanisms composed of springs, hooks, latches, magnets or fittings are found in the prior art. However, mechanisms with sufficient heat resistance for adequately securing a drawer in a fully retracted position in elevated temperature conditions, such as those occurring in stoves, are lacking in the prior art. Catch mechanisms have usually been made of plastic or rubber materials, the properties of which change at high temperatures so that the ability of the catch mechanism to maintain the slide assembly in a retracted position is hindered. Formal deformation, plastic deformation and melting are some problems with rubber and plastic catch mechanisms in stoves.

Some fittings in the prior art are composed of a projection made of elastic material such as rubber mounted to the outer rail, and a recess made of metal and which is part of the inner rail. When the inner rail retracts, the two components fit together and hold the inner rail in its retracted position with some resistance.

There also exists in the prior art a two part spring assembly for latching the inner rail to the outer rail in the former's fully retracted position. This catch mechanism comprises a catch point of the inner rail and a two part spring mounted on the outer rail, one part of which being mounted via a pivot point. The two part spring is also made of plastic. A main problem associated with this two part spring catch mechanism is that the plastic material is susceptible to detrimental changes in properties due to heat, and consequently the functioning of the plastic two part combination can be hindered by excessive heat.

Magnets have also been used to secure drawers in a closed position. In this mechanism, two attractive magnets, or one magnet and another element made of magnetically susceptible material such as steel, which will be referred to as magnetic elements, are attached to the inner and outer rails between them, so that in the fully retracted position the magnetic elements touch and thus require a certain force to overcome the magnetic force and reopen the drawer. In the prior art, the magnetic elements have been substantially rigidly fixed to their respective inner and outer rails, which means that they may not be in flush contact with each other when the drawer is closed. When the magnetic elements are not completely flush their attractive force and thus their resistive effect to extension is greatly reduced. It is also difficult to consistently produce appliances, whose parts are completely aligned when the parts are rigidly fixed to each other. Furthermore, when a wide range of temperatures, including elevated temperatures, is experienced, one or more parts of the appliance, drawer, or drawer slide assembly may warp slightly. Such warping effects may cause formerly flush magnetic elements to become uneven. The effect of heat can thus be detrimental to this kind of drawer slide catch mechanism.

The U.S. Pat. No. 4,932,792 (BAXTER), U.S. Pat. No. 5,671,988 (O'NEILL) and U.S. Pat. No. 6,435,636 (MacMILLAN) describe catch mechanisms for retaining a drawer in a closed position. They disclose mechanisms comprising flexible or compressible arms combined with projections that combine to offer a resistance to opening a drawer from the closed position.

The U.S. Pat. No. 5,248,195 (SHIN et al.), U.S. Pat. No. 4,560,212 (PAPP et al.) and U.S. Pat. No. 4,441,772 (FIELDING et al.) describe catch mechanisms with various mechanical constructions. SHIN et al. and PAPP et al. describe a catch mechanism comprising a latch element that functions with an alternating movement about a pivot point when the drawer is closed. FIELDING et al. describe a rotating latch element that hooks onto a projection, but the purpose of the mechanism is not to retain and bias a drawer in a closed position.

Catch mechanisms should also be able to compensate for the tolerance in drawer fabrication. Thus greater leeway can be achieved in drawer production and functioning.

As conditions of high, low and changing temperatures are especially common within kitchen appliances, an internal catch mechanism for a drawer slide assembly should be able to withstand such conditions in such equipment as, for example, a stove. Increasing the heat resistance of drawer slide assemblies will decrease excessive wear on and maintain proper functioning of the composing parts, and will be advantageous to consumers and users of the equipment.

SUMMARY OF THE INVENTION

An object of the present invention is to provide a drawer slide assembly with catch mechanism that satisfies the above mentioned need.

More particularly, the present invention provides a drawer slide assembly for slidably suspending a drawer in an appliance, such as for example an oven. The drawer slide assembly comprises a telescopic pair of first and second rails slidable between a retracted closed position and an extended open position for respectively closing and opening the drawer. It also includes a rail catch mechanism for resisting slide extension from the retracted position. The rail catch mechanism includes a spring arm having a first end portion mounted to the first rail on a pivot point and a second end portion having an anchorage point. The spring arm is pivotable between an original relaxed position in which the anchorage point is substantially facing toward a first end of the first rail and a resisting position when the spring arm has been pivoted about the pivot axis and in which the anchorage point is substantially facing towards a second end of the first rail. The rail catch mechanism also includes a projection mounted on the second rail to engage the anchorage point of the spring arm when the assembly is slid to the retracted position, thereby causing the spring arm to pivot to the resisting position and forcing the assembly to temporarily remain in the retracted position until a sufficient force is used to release the spring arm and bring the assembly back in the extended position.

The spring arm is preferably mounted to a pivot point comprising a rivet or an opening or a stamp, to which the first end portion is secured. The spring is advantageously a torsion having a first and a second end portions extending from a central coil. The spring preferably has an angle between its first and second end portions of approximately 90° and the second end portion is advantageously substantially S-shaped with first and second curved sections. The second curved portion is at the far end of the second end portion and defines the anchorage point. A stopper is preferably mounted on the first rail for stopping and positioning the spring in the relaxed position when it pivots back from the resisting position.

The catch mechanism is preferably constructed using heat resistant materials such as metals and advantageously stainless steel.

The spring arm is preferably mounted at the back end of the first rail.

The first and second rails are preferably outer and inner channel-section rails respectively, the inner rail being nested within the outer rail and slidable therewith.

BRIEF DESCRIPTION OF THE DRAWINGS

These and other objects and advantages of the invention will become apparent upon reading the detailed description and upon referring to the drawings in which.

Figure 1:
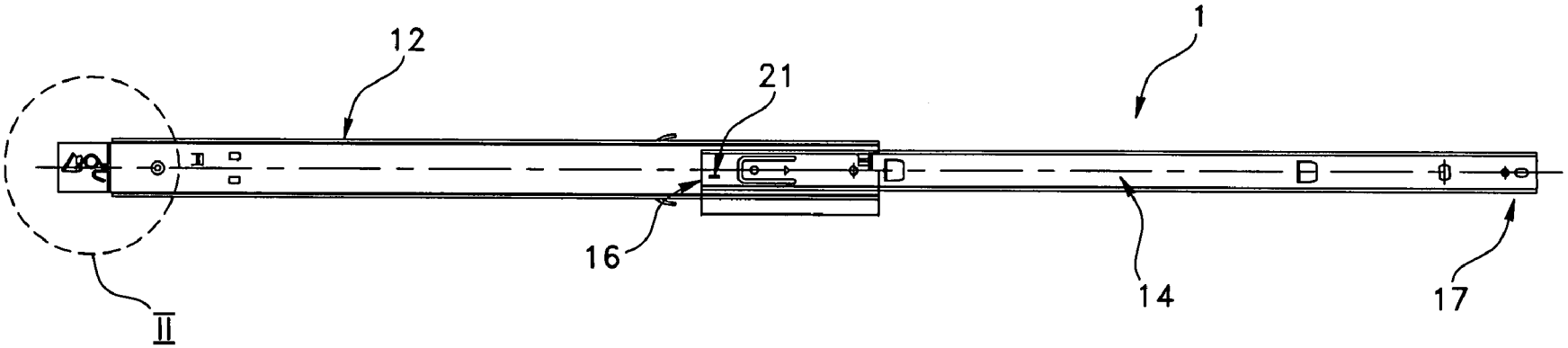
FIG. 1 is a side view of a drawer slide assembly according to a first preferred embodiment of the invention in a fully extended position.

While the invention will be described in conjunction with example embodiments, it will be understood that it is not intended to limit the scope of the invention to such embodiments. On the contrary, it is intended to cover all alternatives, modifications and equivalents as may be included as defined by the appended claims.

DESCRIPTION OF PREFERRED EMBODIMENTS

In the following description, similar features in the drawings have been given similar reference numerals. Some elements are not referred to in some figures if they were already identified in a preceding figure.

According to the present invention, the drawer slide assembly (1) comprises two outer rails (12) mounted to the opposite walls of an opening in a stove in which a drawer is suspended to be slid. An inner rail (14) is slidably mounted on each outer rail (12). The sliding means can comprise ball bearings, wheels and/or an intermediate rail (not shown). The drawer slide assembly (1) may also comprise a stop lever (not shown) for stopping the drawer from falling out and for defining a fully extended position. The drawer is mounted to the inner rails (14). When the drawer is slid toward the fully closed position, a catch mechanism (100) is activated.

FIGS. 1 to 13 show one pair of first and second rails. The first rail is the outer rail (12) and the second rail is the inner rail (14).

Figure 4:
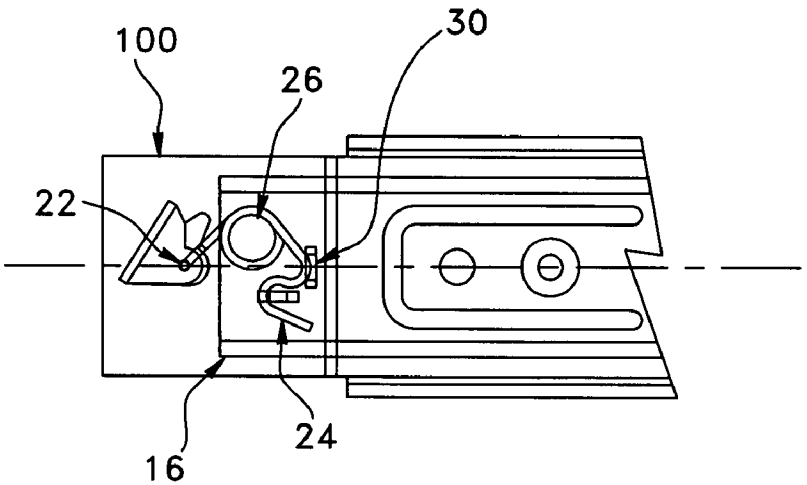
FIG. 4 is a side view of the area IV of the drawer slide assembly of FIG. 3.

Preferably, the catch mechanism (100), as shown in FIG. 4, comprises a first element mounted at the rear end portion (16) of the inner rail (14) and engages a second element mounted at a rear end portion (18) of the outer rail (12). Once the drawer is caught in a closed position, it requires a certain amount of force to disengage the catch mechanism (100) and open the drawer. Such force is usually exerted by a person pulling on a drawer handle and the catch mechanism (100) is designed for an opening force known to someone skilled in the art. In addition, the drawer slide assembly (1) is designed so that extending the drawer from its fully retracted position can be effectuated in a smooth motion.

Figure 2:
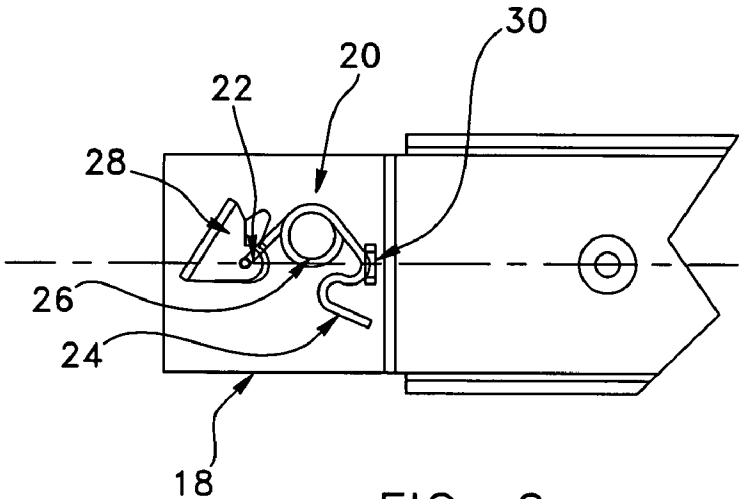
FIG. 2 is a side view of the area II of the drawer slide assembly of FIG. 1.
Figure 3:
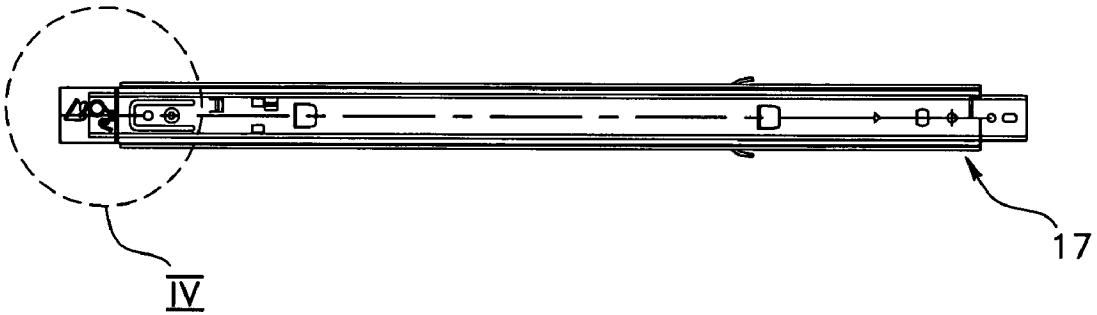
FIG. 3 is a side view of the drawer slide assembly according to the first embodiment of the invention in a retracted position.

In accordance with a preferred embodiment of the invention, as shown in FIGS. 1 and 2 for example, the first catch mechanism element comprises a single spring arm (20), and the second element is a projection (21) projecting from the inner rail (14). The spring arm (20) is made of a heat resistant, preferably metallic material. Its first end portion (22) is mounted to the outer rail (12) on a pivot point, and its second end portion is substantially S-shaped having first and second curved sections, the second curved section defining an anchorage point. A wire coil (26) is provided between the first end (22) and the second end (24) portions. In its relaxed position, the spring arm (20) is preferably oriented so that its second end portion (24) is below its first end portion (22), as in FIGS. 1 and 2, but the opposite orientation may also be used.

The spring arm (20) is preferably a torsion spring. The torsion spring advantageously has a substantially 90° angle between opposite spring arms when relaxed. Spring arms with an angle of substantially 270°, as well as other angles could alternatively be used in the catch mechanism. Various torsion springs may be used and specifically designed for the present application. The torsion spring may have a single or numerous coils, the opposite arms may be oriented at various angles from one another, and the torque required to compress or extend the spring may be varied. Also, the coil diameter, the wire diameter and the spring length may be adjusted depending on the desired characteristics of the spring. The coil (26) in particular provides the spring arm (20) with a springing ability.

The pivot point is fixed to the outer rail (12) by means of an opening or recess (28), cut or stamped into the outer rail (12). Alternatively, and according to FIG. 10, the catch mechanism (100) further comprises a rivet (31) that serves as part of the pivot point. The rivet (31) takes the place of the opening (28) (as in FIGS. 1 to 6), as the means of mounting a pivot point about which the spring arm (20) rotates.

When the spring arm (20) is in the "relaxed position," it is oriented so that the anchorage point can be engaged by the projection. In this position, there is preferably little to no tension in the spring arm, but there can also be some tension in the same. Likewise, in the "resisting position" there is preferably a certain degree of tension in the spring arm, but there can also be little to no tension in the same. Nevertheless, extension from the resisting position as well as retraction from the relaxed position cause the spring arm to experience bending, flexing and/or compressing (i.e. tensional forces).

Figure 5:
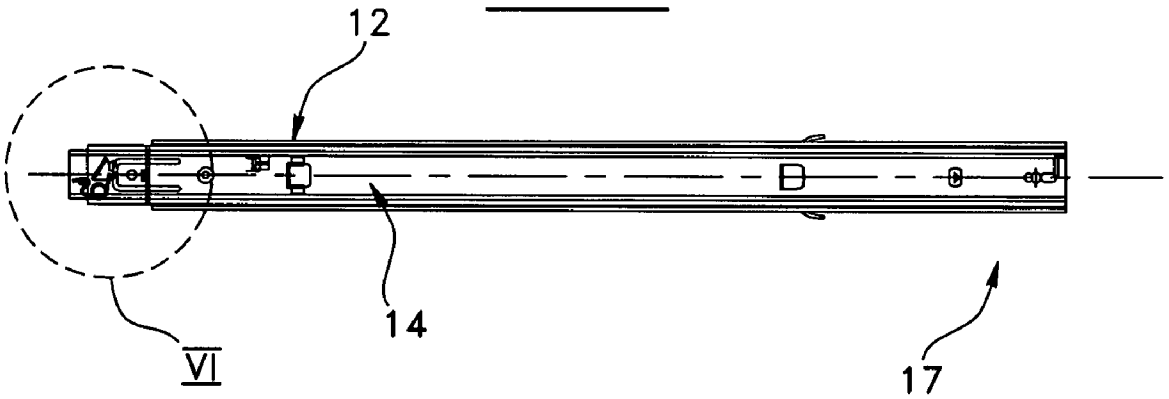
FIG. 5 a side view of the drawer slide assembly according to the first embodiment of the invention in a fully retracted position.
Figure 6:
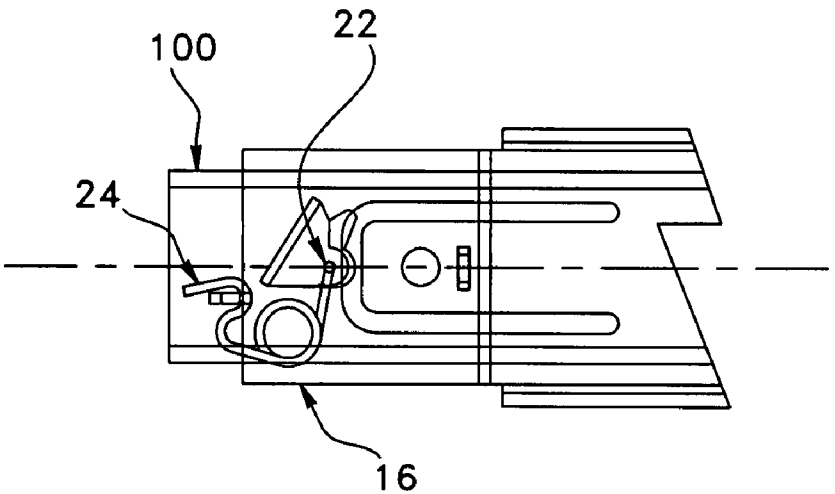
FIG. 6 is a side view of the area VI of the drawer slide assembly of FIG. 5.
Figure 7:
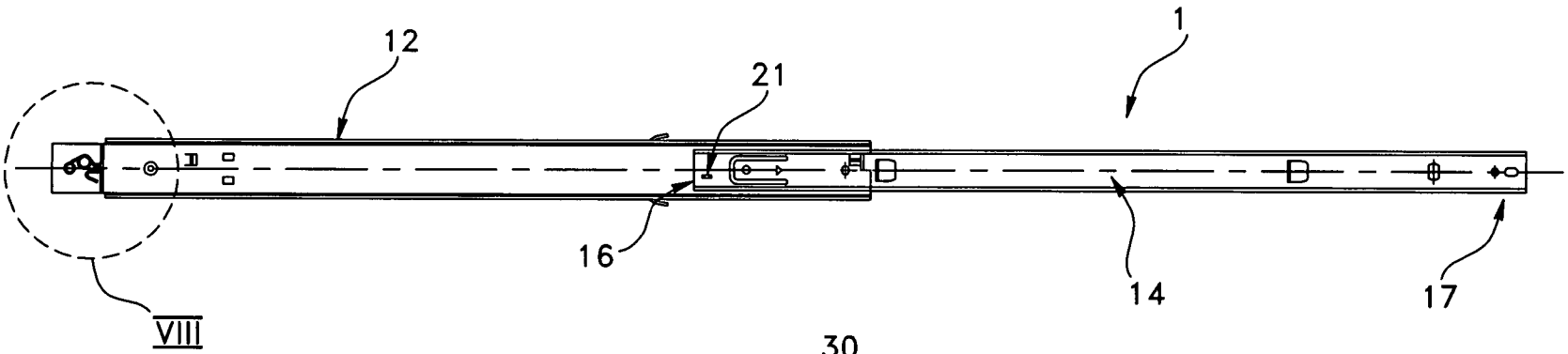
FIG. 7 is a side view of a drawer slide assembly according to a variant of the first embodiment of the invention in a fully extended position.
Figure 8:
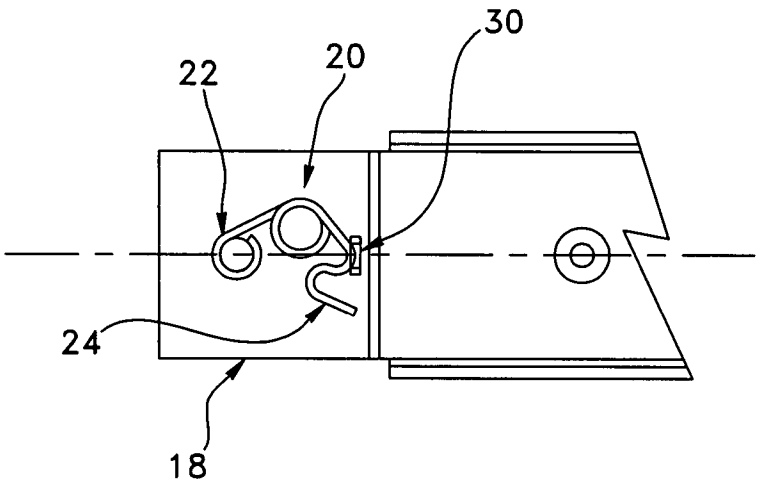
FIG. 8 is a side view of the area VIII of the drawer slide assembly of FIG. 7.
Figure 9:
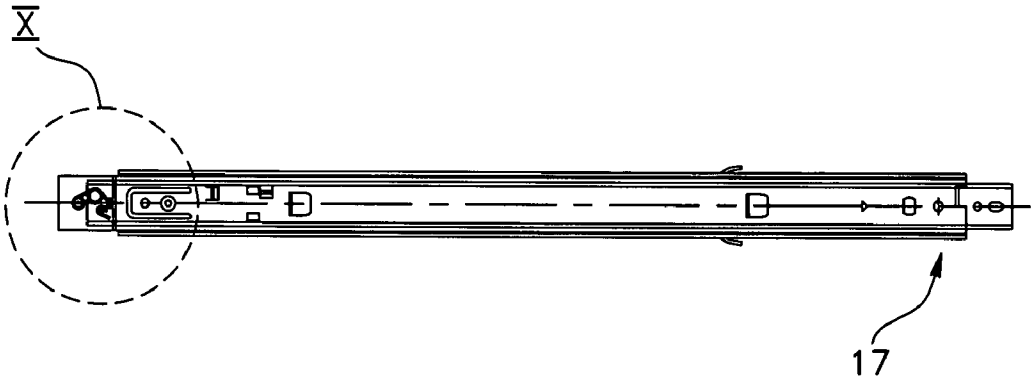
FIG. 9 is a side view of the drawer slide assembly according to a variant of the first embodiment of the invention in a retracted position.
Figure 10:
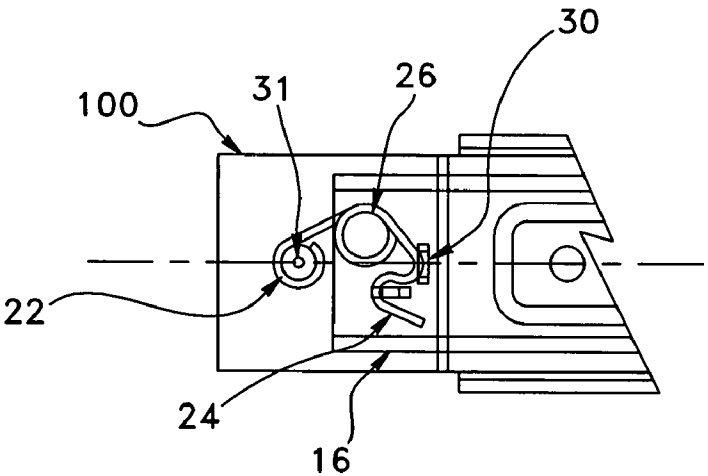
FIG. 10 is a side view of the area X of the drawer slide assembly of FIG. 9.
Figure 11:
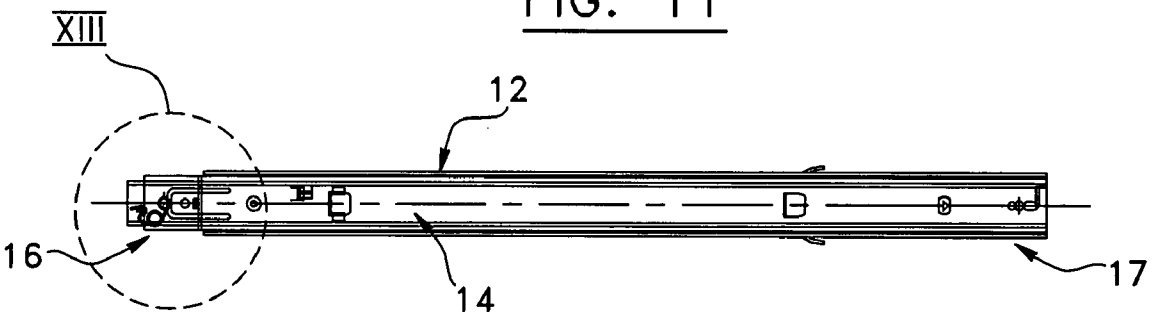
FIG. 11 a side view of the drawer slide assembly according to the variant of the first embodiment of the invention in a fully retracted position.
Figure 12:
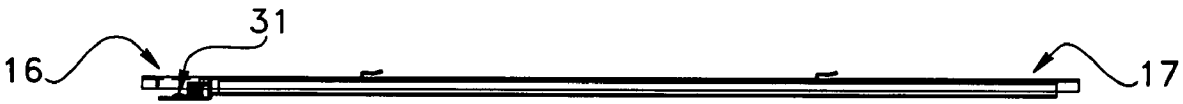
FIG. 12 is a bottom view of the drawer slide assembly shown in FIG. 11.
Figure 13:
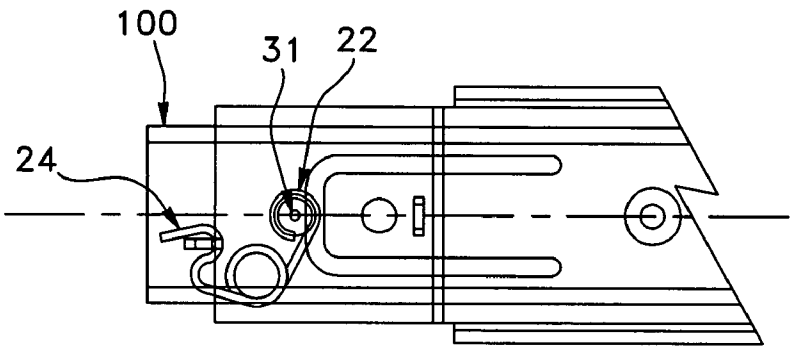
FIG. 13 is a side view of the area XIII of the drawer slide assembly of FIG. 11.

In a full extension position, as shown in FIG. 2 or 8, the spring arm (20) preferably rests on a spring stopper (30), and the second curved section of the second end postion (24) of the spring arm (20) is substantially facing toward the front end (17) of the rail. In this case, "substantially facing" indicates that the anchorage point is facing the proper direction, and is in the correct orientation so as to be engageable by the projection (21), and that in this position the spring arm resists rotation. As the inner rail (14) is brought to the retracted position, the projection (21) engages the anchorage point of the second end portion (24), thereby causing the spring arm (20) to rotate about its pivot axis. While the anchorage point faces toward the front end (17) of the rail, the spring arm (20) resists the retraction of the inner rail (14), and is thus in a retracted yet open position. At this point, the spring arm (20) exerts a pull force resisting retraction. When the spring (20) rotates so that the anchorage point substantially faces toward the rear end (18) of the rail, and thus is in a fully closed position, the spring arm (20) resists the extension of the inner rail (14). When rotating, the spring may undergo deflection at both ends, and the deflection experienced by the spring arm depends on the spring construction and its precise arrangement in relation to the projection (21). At this point, when it has been rotated, the spring arm (20) exerts a force resisting extension. The Figures show the assembly in an extended position (FIGS. 1 and 2), a retracted position (FIGS. 3 and 4) at which the projection of the inner rail (14) engages the anchorage point of the spring arm (20) and a fully retracted position (FIGS. 5 and 6). The projection (21) can be hook-shaped or square-shaped. Also, it can project away from the outer rail or towards the outer rail, depending on the arrangement of the spring arm (20) and of the spacing, construction and mounting of the inner and outer rails.

In accordance with a variant of the present invention (not illustrated), the projection is mounted to the rear end portion of the outer rail and the spring arm is mounted to the rear portion of the inner rail. The catch mechanism functions similarly to the mechanism mentioned hereabove, but the spring arm is movable between an original relaxed position in which the anchorage point is facing toward the rear end of the rail and a resisting position when the spring arm has been pivoted about the pivot axis and in which the anchorage point is facing towards the front end of the rail. Thus, in this variant, the first and second elements of the catch mechanism are simply located on the opposite rails respectively.

As mentioned above, the first and second elements of the rail catch mechanism (i.e. the spring arm and projection) are preferably respectively mounted on a rear end portion of the inner and outer rails. In another embodiment of the invention (not illustrated), the rail catch mechanism elements may be mounted on other portions of the inner and outer rails for resisting retraction of the drawer. The arrangement and orientation of the first and second elements may be modified by someone skilled in the art in order to achieve the desired tolerance, resistance and efficiency of the drawer slide assembly.

The present invention also encompasses the embodiment in which the spring arm and/or the projection are indirectly or adjacently mounted to the rails. In this case, they can be mounted adjacent to the rails on the inner wall of the appliance and the outer wall of the drawer respectively. In this case, the catch mechanism has similar functional principles with respect to the sliding of the rails, and has similar action as the other preferred embodiments. Thus the spring arm's and the projection's being mounted directly, indirectly or adjacent to the rails, are all envisioned as different alternative embodiments included in the invention.

Advantageously, the pivot point, the projection and the anchorage point are greased with heat resistant grease for increasing the smoothness of the catch mechanism operation. These elements also preferably include rubberized or magnetic additions to dampen or modify their connection.

Preferably, the drawer slide assembly is used in combination with another similar drawer slide assembly. The two assemblies are mounted, preferably via the inner rail, to opposite sides of the drawer to be slid in an out of an appliance cavity. Each assembly is also mounted, preferably via the outer rail, to opposite internal walls of the appliance cavity.

The first element is preferably a projection. The projection may take the form of a slot, bump, jut, bar, hook or another form suitable for engaging the anchorage point of the spring arm. The projection may also have flexing properties or springing properties for modifying the resistance to opening the drawer.

The use of a single spring arm (20) has the additional advantages of a) reducing the friction between parts that must slide on each other creating wear due to friction, b) reducing the assembly cost incurred when assembling two parts, and c) maintaining a desirable flexibility and compensation, providing a level of tolerance for drawer production and usage.

Although preferred embodiments of the present invention have been described in detail herein and illustrated in the accompanying drawings, it is to be understood that the invention is not limited to these precise embodiments and that various changes and modifications may be effected therein without departing from the scope or spirit of the present invention.

The invention claimed is:

1. A drawer slide assembly for slidably suspending a drawer in an appliance, the drawer slide assembly comprising:

a telescopic pair of first and second rails slidable between a retracted closed position and an extended open position for respectively closing and opening the drawer, and;

a rail catch mechanism for resisting slide extension from the retracted closed position, the rail catch mechanism comprising:

a spring arm having a first end portion mounted to said first rail on a pivot point and a second end portion having an anchorage point; the spring arm being pivotable between an original relaxed position in which the anchorage point is substantially facing toward a first end of the first rail and a resisting position when the spring arm has been pivoted about the pivot axis and in which the anchorage point is substantially facing towards a second end of the first rail; and a projection mounted on the second rail to engage the anchorage point of the spring arm when the assembly is slid to the retracted position thereby causing the spring arm to pivot to the resisting position and forcing the assembly to temporarily remain in the retracted position until a sufficient force is used to release the spring arm and bring the assembly back in the extended position;

wherein the spring arm is a torsion spring comprising a coil with said first end portion and second end portion extending from the coil.

2. The drawer slide assembly as claimed in claim 1, wherein the second end portion of the spring arm is substantially S-shaped with a first curved section extending from the coil and a second curved section extending from the first curved section, the anchorage point being located in the second curved section.

3. The drawer slide assembly as claimed in claim 1, wherein the first and second end portions are oriented at substantially 90° from each other when the spring arm is in the relaxed position.

4. The drawer slide assembly as claimed in claim 3, wherein the second end portion is located below the first end of the spring arm when in the relaxed position whereby the second end portion passes under the pivot point when the spring arm pivots to the resisting position.

5. The drawer slide assembly as claimed claim 1, further comprising a stopper mounted on the first rail to stop and position the spring arm in the relaxed position when it pivots back from the resisting position.

6. The drawer slide assembly as claimed in claim 1, wherein the spring arm is mounted at a back end of the first rail and the projection is mounted at a back end of the second rail.

7. The drawer slide assembly as claimed in claim 1, wherein the pivot point comprises a rivet securing the first end portion to the first rail.

8. The drawer slide assembly as claimed in claim 1, wherein the pivot point comprises an opening or stamp in the first rail into which the first end portion is secured.

9. The drawer slide assembly as claimed in claim 1, wherein the catch mechanism is made of a heat resistant material.

10. The drawer slide assembly as claimed in claim 9, wherein the catch mechanism is made of metal.

11. The drawer slide assembly as claimed in claim 9, wherein the catch mechanism is made of stainless steel.

12. The drawer slide assembly as claimed in claim 1, wherein the first rail is a channel-section outer rail securable to an inner wall of the appliance and the second rail is a channel-section inner rail securable to a side wall of the drawer, the second rail being nested within the first rail in a slide relationship therewith.

* * * * *